United States Patent [19]

Anderson

[11] Patent Number: 4,484,611

[45] Date of Patent: Nov. 27, 1984

[54] VENETIAN BLIND STRUCTURE

[75] Inventor: Richard N. Anderson, Owensboro, Ky.

[73] Assignee: Hunter Douglas Inc., Totowa, N.J.

[21] Appl. No.: 567,171

[22] Filed: Dec. 30, 1983

Related U.S. Application Data

[63] Continuation of Ser. No. 384,286, Jun. 2, 1982.

[51] Int. Cl.[3] ..... E06B 3/32

[52] U.S. Cl. ..... 160/107

[58] Field of Search ..... 160/107, 168–178, 160/236; 49/61, 64, 371; 52/754, 758 D; 403/40, 164, 165

[56] References Cited

U.S. PATENT DOCUMENTS

| | | | |
|---|---|---|---|
| 1,022,415 | 4/1912 | Hannam | 160/174 |
| 2,269,579 | 1/1942 | Chilton | 160/107 |
| 2,288,521 | 1/1940 | Gregory . | |
| 2,311,716 | 2/1943 | Walker | 160/178 R |
| 2,337,984 | 12/1943 | Flowers | 52/758 D |
| 2,486,000 | 10/1949 | Browing | 160/107 |
| 2,631,339 | 3/1953 | Pratt . | |
| 2,837,152 | 6/1958 | Moore, Jr. | 160/236 |
| 2,952,486 | 9/1960 | Reuter et al. | 403/40 |
| 3,068,938 | 12/1962 | Hull | 110/176 |
| 3,389,737 | 12/1965 | Arnold et al. . | |
| 3,719,221 | 2/1971 | Hanson . | |
| 3,858,910 | 1/1975 | Oetiker | 403/165 |

FOREIGN PATENT DOCUMENTS

| | | |
|---|---|---|
| 263181 | 5/1964 | Australia . |
| 2095958 | 2/1972 | France . |
| 1193333 | 5/1970 | United Kingdom . |

*Primary Examiner*—Peter M. Caun

*Attorney, Agent, or Firm*—Pennie & Edmonds

[57] ABSTRACT

A venetian blind structure having a plurality of tiltable slats and slat support means including a top pivotal bearing structure remote from and above the top slat and a bottom pivotal bearing structure remote from and below the bottom slat. The slat support means extend between and are connected to the top and bottom pivotal bearing structure which in turn are adapted to be fixed to top and bottom frame members of a window opening.

6 Claims, 7 Drawing Figures

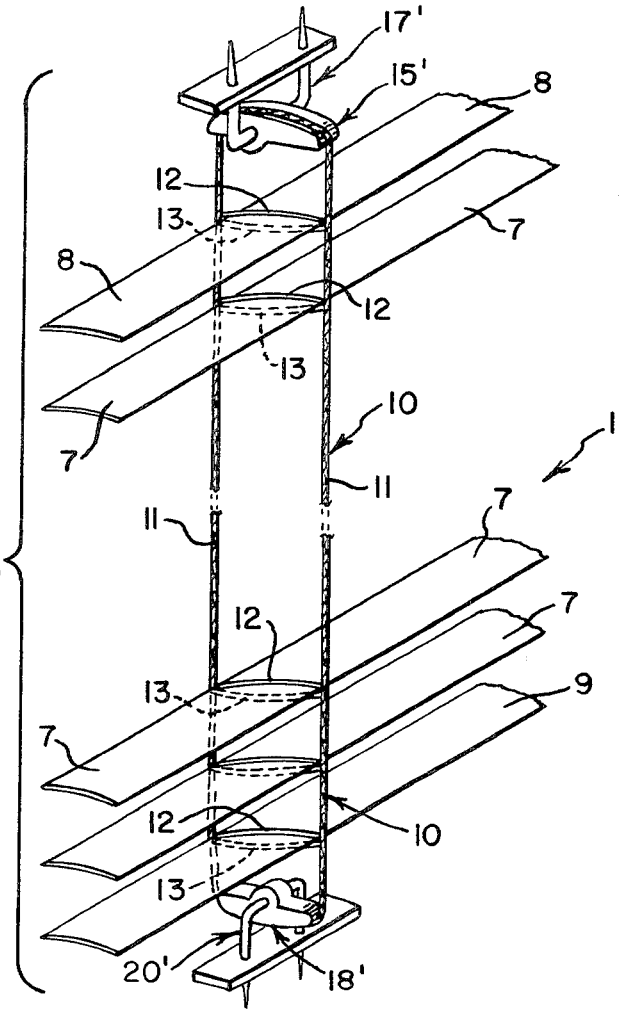
FIG. 6
FIG. 7
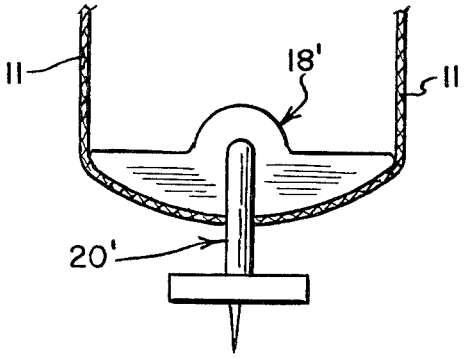

VENETIAN BLIND STRUCTURE

CROSS REFERENCE TO OTHER APPLICATIONS

This application is a continuation of my copending U.S. patent application Ser. No. 384,286 filed June 2, 1982. This application is related to application Ser. No. 184,060 filed Sept. 4, 1980, now abandoned, in turn a continuation of U.S. patent application Ser. No. 076,713 filed Sept. 19, 1979, now abandoned, in turn a continuation of U.S. patent application Ser. No. 953,235 filed Oct. 20, 1978, now abandoned, in turn a continuation of U.S. patent application Ser. No. 885,035 filed Mar. 9, 1978, now abandoned, in turn a continuation of U.S. patent application Ser. No. 709,869 filed July 29, 1976, now abandoned and for which related applications no claim of priority is made.

TECHNICAL FIELD

This invention relates to a venetian blind structure and more particularly to a venetian blind structure incorporating a plurality of slats having a simplified assembly of parts necessary to effect tilting of the slats.

BACKGROUND OF THE INVENTION

Venetian blind structures are known which incorporate a plurality of slats supported by slat support means, for example a tape ladder, where the slat support means is suspended from a tilt bar in turn rotatably mounted in a headrail. An example of this type of structure is disclosed in U.S. Pat. No. 2,837,152. Such a structure usually however requires a complicated mounting arrangement and use of an extra heavy bottom slat which requires increase in slat inventory and consequently increase in cost of installation.

A further known construction mounts the top slat of the blind structure in a bearing structure where the pivotal axis of the bearing structure coincides with the pivotal axis of the top slat. The slat supporting means supporting the remainder of the slats is suspended from the top slat which, in order to support the weight of the other slats, is of a heavier construction than the other slats thus increasing slat inventory requirements.

Further in many of the prior art blind assemblies there may be interference between the top slat and its hanger assembly which tends to restrict the degree of slat closure of the top slat and consequently of all of the slats.

Many venetian blind structures to date are only applicable for use where the blind is positioned in a vertical plane, that is to say, they may not be used in installations where the plane of the blind is inclined with respect to a vertical plane.

It is therefore an object of my invention to provide for a venetian blind structure which has a simplified means for suspending the structure from a top frame member of a window opening and which does not require any specially designed slats.

It is a further object of my invention to provide for a venetian blind structure which is readily adaptable for use in window frames that may be inclined with respect to a vertical plane.

GENERAL DESCRIPTION OF THE INVENTION

Broadly a venetian blind structure constructed according to my invention comprises a plurality of tiltable slats and a slat support means for supporting the slats. A top pivotal bearing structure which serves as a remote spreader pivot is adapted to be fastened to a top frame member of a window opening and is positioned remote or spaced from and above the slats such that its pivot axis is remote or offset from the slats. The slat support means is suspended from the pivotal bearing structure. A bottom pivotal bearing structure which serves as a remote spreader pivot similar to the top bearing structure is positioned remote from and below the slats and to which the slat suspension means are connected and so that its pivot axis is also remote or offset from the slats. The bottom pivotal bearing member is adapted to be secured to a bottom frame member of the window frame.

Preferably the slat support means comprises a tape ladder having pairs of upper and lower rungs extending between two tape cables with a slat extending between each pair of rungs. In the alternative the slats may be connected at their edges directly to cables.

Each of the top and bottom pivotal bearing structures may comprise a rotatable quadrant to which the slat support means are connected and where the quadrant has a circular guide surface concentric with a pivotal axis and a guide bracket which engages the guide surface. The guide bracket in turn is adapted to be secured to a frame member of a window opening.

The radius of the guide surface is substantially equal to one-half the width of a slat to assure that there will be no interference of the top or bottom slats with a guide bracket on closure of the slats.

A tilt operation means may be connected directly to a tape cable or to any one of the slats. It may be desirable in the latter instance to have the slat to which the tilt operation means is connected of a slightly heavier or stronger construction in order to withstand torsional forces imparted by the tilt operation means.

BRIEF DESCRIPTION OF THE DRAWINGS

FIG. 6 is a perspective view of a venetian blind assembly constructed according to the invention similar to that of FIG. 1; and FIG. 7 is an enlarged sectional end view of a portion of FIG. 6.

DETAILED DESCRIPTION OF THE PREFERRED EMBODIMENTS

Figure 1:
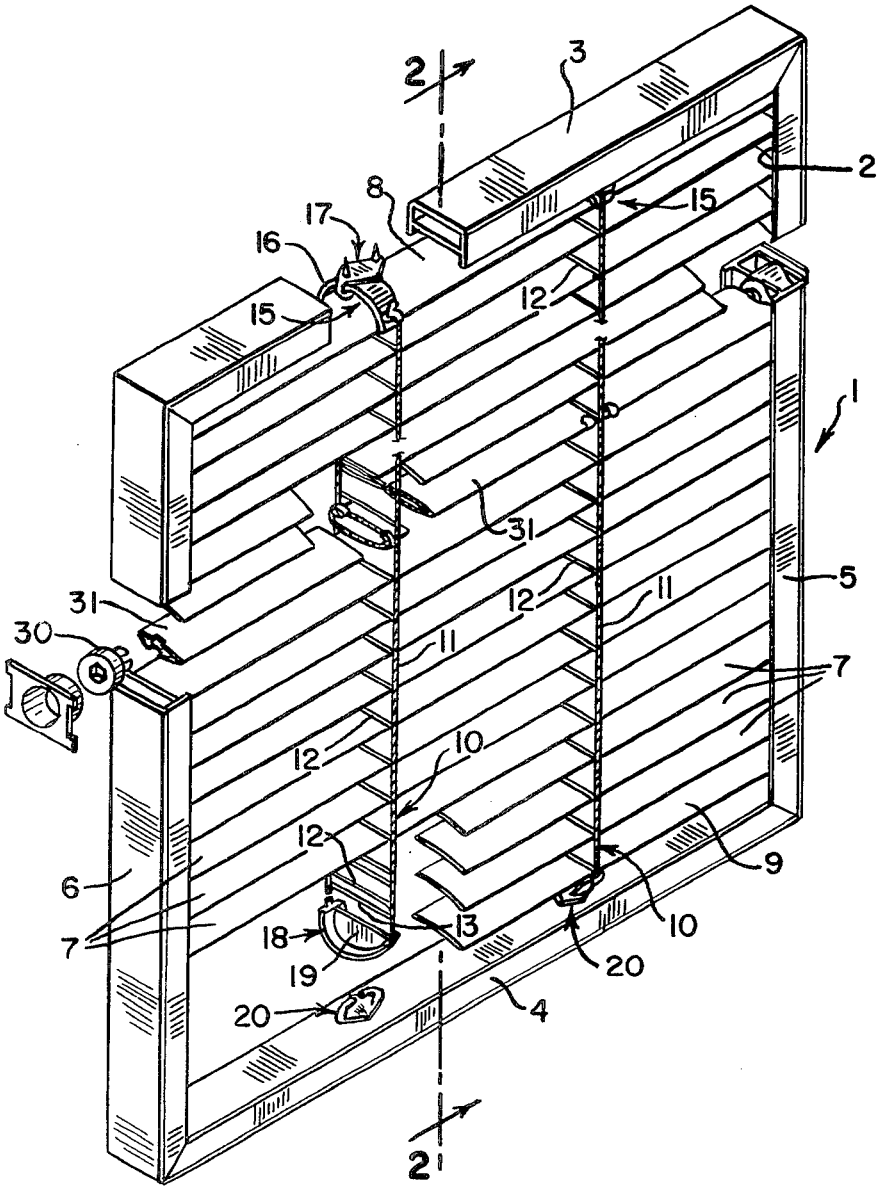
FIG. 1 is a perspective view of a venetian blind structure constructed according to the invention installed in a window opening.
Figure 2:
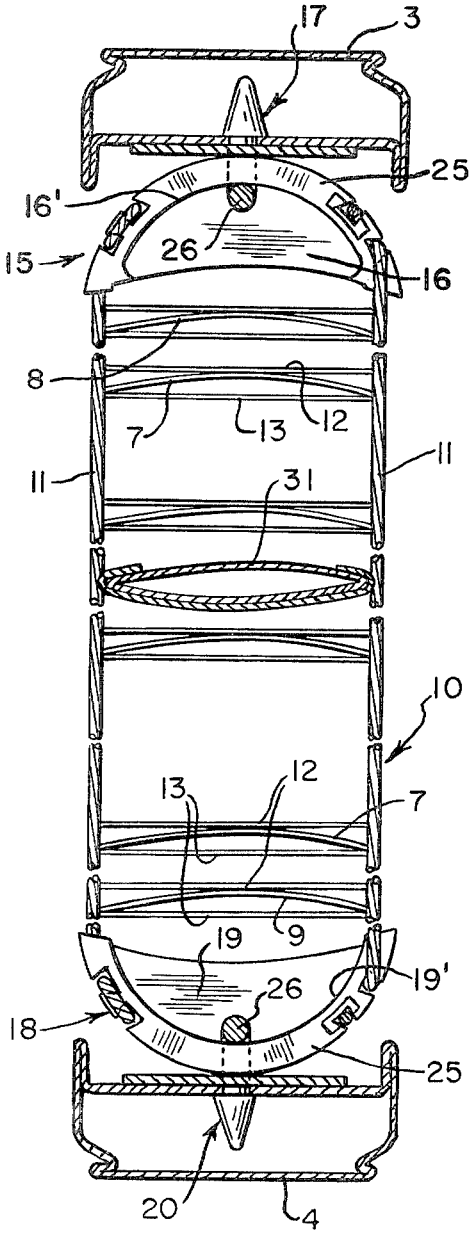
FIG. 2 is an enlarged broken cross-sectional view of FIG. 1 taken along lines 2—2.

Referring to FIG. 1 there is illustrated a venetian blind structure 1 installed within a window opening 2 having a top frame member 3, a bottom frame member 4 and side frame members 5 and 6. The venetian blind structure 1 comprises a plurality of slats 7 including a top slat 8 and a bottom slat 9. All of the slats are supported by means of two slat support means 10 which take the form of tape ladders comprising tape cables 11 having pairs of upper rungs 12 and lower rungs 13 which as shown in FIG. 2 extend between the cables. An end of a slat extends between each pair of rungs.

As shown in greater detail in FIG. 2 the cables 11 of the slat support means 10 are suspended from a top pivotal bearing structure 15 comprising a rotatable quadrant 16 and a guide bracket 17. The guide bracket 17 is secured to an upper frame member 3 of the window opening.

The tape cables 11 are also connected to a bottom pivotal bearing structure 18 comprising a rotatable quadrant 19 and a guide bracket 20 secured to the bottom frame member 4 of the window opening. The top and bottom bearing structures 15 and 18 are identical thus reducing inventory requirements. Both quadrants 16 and 19 each have a circular guide survace 16' and 19' which slidably engage with the guide brackets 17 and 20.

Figure 3:
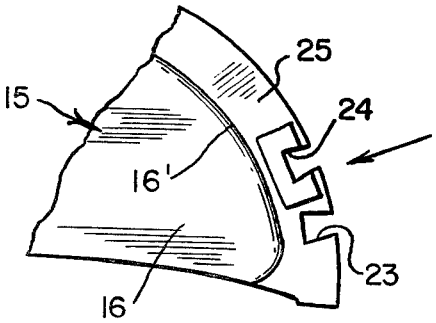
FIG. 3 is an enlarged view of a portion of FIG. 2.
Figure 4:
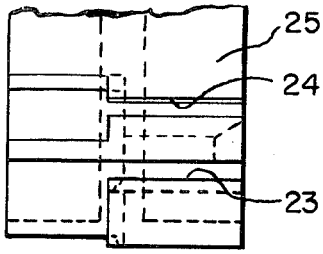
FIG. 4 is a view of a portion of FIG. 3 taken in the direction of the arrow shown in FIG. 3.

The cables 11 are connected at each end to the quadrants 16 and 19 by threading through slots 23 and 24 as shown in FIGS. 3 and 4 contained within a rim 25 of the quadrants.

Figure 5:
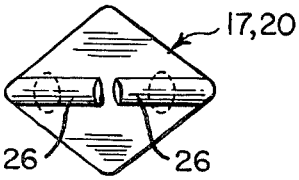
FIG. 5 is a plan view of a guide bracket utilized in a construction according to the invention.

The top and bottom guide brackets 17 as shown in FIG. 5 each have two depending arms 26 which are spaced apart at their ends in order that they may snap over the rim 25 of the quadrants whereby the ends of the arms may slidably engage the guide surface of the quadrants. Instead of the arms engaging guide surfaces, they could instead engage curved grooves contained within the quadrant, the only requirement being that the quadrant be rotatable about a pivot axis extending parallel to the longitudinal axis of the slats and that the pivot axis be remote or offset from the planes of the top and bottom slats.

In order to accommodate the width of the slats, it is necessary that the radius of the guide surfaces be approximately one-half of the width of the slats to assure that there is no interference when the slats are pivoted to a closed position.

It is seen by the construction shown in FIG. 2 that it is not necessary to have heavier top and bottom slats to provide the support necessary for the slat support means and that the top and bottom slats may be identical with the remainder of the slats making up the venetian blind structure. This reduces the need of maintaining an inventory of different slats and thus reduces expenses of manufacture and installation.

The slats may be tilted by moving cables 11 up or down by applying a force directly to the cables or, as shown in FIG. 1, a separate tilt operation knob 30 may be utilized and which connects directly with a slat 31. As slat 31 is tilted about its longitudinal axis by knob 30, it will force the tape ladders to move and to consequently tilt the remainder of the slats about their longitudinal axes as well as causing the quadrants forming part of the pivotal bearing structure to rotate about their pivot axes. It may be desirable, although not essential, to make the slat 31 heavier than the remainder of the slats to accommodate the torsional forces imparted by the knob 30.

Referring to FIGS. 6 and 7 in which parts like those in FIGS. 1–5 have like identification numerals, the upper pivotal bearing structure 15' over which the cable 11 extends is pivotally supported by an upper bracket 17' adapted to be attached to an upper frame member, not shown, while the lower pivotal bearing structure 18' is pivotally supported by a lower bracket 20' adapted to be attached to a lower frame member, not shown. Both upper and lower pivotal bearing structures 15' and 18', like structures 15 and 18, are remote or offset from the planes of the top and bottom end slats 8 and 9. Top and bottom pivotal bearing structures 15' and 18' are identical, as well as brackets 17' and 20', thus reducing inventory requirements.

The slats of the FIG. 6 construction may be tilted in the same manner as with the construction as shown in FIG. 1, namely by applying a tilting force directly to a cable 11 or through a tilt operation knob, not shown, connected to one of the slats.

Since the invention provides for the bottom pivotal bearing structure to be secured to the bottom frame member of the window opening, and because the cables 11 extend between and are connected to both the upper and lower pivotal bearing structures, it is apparent that the configurations shown in FIGS. 1 and 6 could be inclined witn respect to a vertical plane and still completely cover and close a window opening inclined with respect to a vertical plane.

It is thus seen that a venetian blind structure as described comprises a minimum of easily fabricated parts and which will provide an efficient tiltable blind assembly free from slat interference upon complete closure.

I claim:

1. A venetian blind structure having a plurality of tiltable slats and a plurality of slat support means for supporting said slats, the improvement characterized in having a plurality of top pivotal bearing structures extending along a length of said slats and remote from and above said slats adapted to be secured to a first frame member, in having a plurality of bottom pivotal bearing structures extending along a length of said slats and spaced remote from and below said slats adapted to be secured to a second frame member opposite said first frame member, and in having a slat support means extending from each top pivotal bearing structure and connected to a bottom bearing structure, said bearing structures each being adapted to pivot about a pivot axis being spaced remote from and extending substantially parallel to the longitudinal axes of the slats.

2. A venetian blind structure according to claim 1 the improvement further comprising in that said slat support means comprise a tape ladder.

3. A venetian blind structure according to claim 1 wherein each said pivotal bearing structure comprises a quadrant to which said slat suspension means are connected having a circular guide surface concentric with a pivot axis, and a guide bracket slidably engaging said guide surface with said guide bracket adapted to be secured to a frame member.

4. A venetian blind assembly according to claim 3 wherein the radius of each said circular guide surface is substantially equal to one-half the width of said slats.

5. A venetian blind assembly according to claim 1 having in addition tilt operation means connected to a slat supporting means to move the same to cause each said pivotal bearing structure to pivot about its associated pivot axis and to cause all of said slats to tilt.

6. A venetian blind structure according to claim 5 wherein said tilt operation means comprise an operation knob connected to an end of one of said slats whereby said one of the said slats may be tilted about its longitudinal axis to cause said slat supporting means to tilt the remainder of the slats about their longitudinal axes.

* * * * *